US007223931B2

(12) United States Patent
Kiyono et al.

(10) Patent No.: US 7,223,931 B2
(45) Date of Patent: May 29, 2007

(54) SWITCH

(75) Inventors: Yasuhiro Kiyono, Nagaokakyo (JP); Toshihiro Naruo, Kyoto (JP)

(73) Assignee: OMRON Corporation, Kyoto-shi (JP)

( * ) Notice: Subject to any disclaimer, the term of this patent is extended or adjusted under 35 U.S.C. 154(b) by 0 days.

(21) Appl. No.: 11/415,371

(22) Filed: May 1, 2006

(65) Prior Publication Data

US 2006/0246755 A1 Nov. 2, 2006

(30) Foreign Application Priority Data

May 2, 2005 (JP) ..... 2005-134235

(51) Int. Cl.
*H01H 15/02* (2006.01)

(52) U.S. Cl. ..... 200/563; 200/553; 200/559; 200/276.1

(58) Field of Classification Search .... 200/16 R–16 D, 200/520, 530–536, 553, 557–559, 561–563, 200/276.1, 61.82
See application file for complete search history.

(56) References Cited

U.S. PATENT DOCUMENTS 5,796,058 A * 8/1998 Aimi et al. ..... 200/16 D
5,912,445 A * 6/1999 Takedomi ..... 200/276.1
6,559,401 B2 * 5/2003 Minami et al. ..... 200/559
6,762,379 B1 * 7/2004 Su ..... 200/276.1
6,768,069 B1 * 7/2004 Su ..... 200/276.1
6,917,008 B1 * 7/2005 Ni ..... 200/563
7,041,919 B2 * 5/2006 Nishimura et al. ..... 200/61.41
7,067,751 B2 * 6/2006 Nishimura et al. ..... 200/293

FOREIGN PATENT DOCUMENTS

JP 2004-327115 11/2004

OTHER PUBLICATIONS

Patent Abstracts of Japan, Publication No. 2004-327115, Publication Date: Nov. 18, 2004, 14 pages.

* cited by examiner

*Primary Examiner*—Michael A. Friedhofer
(74) *Attorney, Agent, or Firm*—Osha Liang LLP

(57) ABSTRACT

A switch is provided, which is stable in operating characteristics and can be operated with a small operating force, and which is long in life and easy to manufacture. The switch comprises a base, a moving contact piece having one end thereof, which is supported pivotally on the base, coming into pressure contact with a common stationary contact, an operating lever having one end thereof supported pivotally on the base and having a drive part, which extends from the one end, pushing a coil portion of the moving contact piece, and a cover fixed to the base to compress the coil portion. The operating lever pushes the coil portion of the moving contact piece whereby the moving contact piece turns about an end thereof, the coil portion slides on a bottom surface of the base, and the other end of the moving contact piece slides on a stationary contact exposed from an inner surface of the base.

8 Claims, 11 Drawing Sheets

40,42
17
43
21
21a
32
22
30,31
16
33
20b
20
11
22a
10
20a 40,42
18
17
43
21
21b
20c
20d
22b
22
32
30,31
16
33
20
10

SWITCH

BACKGROUND OF THE INVENTION

1. Field of the Invention

The present invention relates to a switch, and more particular, to a thin-type switch mountable on a printed board.

2. Background Art

Conventionally, a thin-type switch mountable on a printed board comprises, for example, a housing having a space therein, a first stationary terminal having an end provided outside the housing and the other end provided inside the housing and provided with a contact portion having a contact groove, a second stationary terminal having an end provided outside the housing and the other end provided inside the housing and provided with a contact portion, a contact piece provided in the housing, provided at an end thereof with a stationary portion, which is latched in the contact groove of the first stationary terminal to contact with the contact portion of the first stationary terminal, and at the other end thereof with a moving portion capable of contacting with the contact portion of the second stationary terminal, the contact piece being biased by a coil spring formed at an intermediate portion thereof in a direction of twist and in a direction of compression, and an operating body provided at a base end thereof with a support portion, which is provided in the housing and defines a center of swinging, the remaining portion thereof being capable of swinging about the support portion as the center of swinging, and formed with a push surface, which abuts against the contact piece, the operating body swinging to enable pushing the contact piece in the direction of twist (see JP-A-2004-327115).

With the switch described above, however, the operating body 60 directly pushes the moving portion 50*e* being one end of the contact piece 50 made of a coil spring, and the contact portion 50*g* of the operating body slides on the contact portion 40*c* of the second stationary terminal while twisting the contact piece 50. Therefore, when the operating body 60, the contact piece 50, etc. involve dispersion in outside dimension and assembly accuracy, unexpected elastic deformation such as warping of the moving portion 50*e*, or the like is liable to occur. Consequently, dispersion is liable to generate in contact pressure, at which the contact portion 50*g* of the operating body contacts with the contact portion 40*c*, and so the operating characteristics are liable to become unstable. Accordingly, when it is tried to ensure a desired operating characteristics, the switch described above needs high part accuracy and assembly accuracy, so that manufacture is not easy.

Also, in order to perform contact switchover in the switch described above, it is necessary to increase a twist angle of the moving portion 50*e*. Therefore, there is caused a problem that a large operating force is necessary and a torsional moment acting on the contact piece 50 becomes large to make the switch susceptible to fatigue and short in life.

SUMMARY OF THE INVENTION

In view of the problem described above, the invention has its object to provide a switch, which can be operated with a small operating force and is long in life and easy in manufacture.

In order to solve the problem, a switch according to the invention has a construction comprising a base, a moving contact piece made of a coil spring and having one end thereof, which is supported pivotally on the base, coming into pressure contact with a common stationary contact, an operating lever having one end thereof supported pivotally on the base and having a drive part, which extends from the one end, pushing a coil portion of the moving contact piece, and a cover having a planar shape capable of covering the base and fixed to the base to compress the coil portion, and in which the operating lever pushes the coil portion of the moving contact piece to give thereto a torsional moment whereby the moving contact piece turns about an end thereof, the coil portion of the moving contact piece slides on a bottom surface of the base, and the other end of the moving contact piece slides on at least one stationary contact exposed from an inner surface of the base.

According to the invention, the operating lever pushes the coil portion of the moving contact piece, which is made of a coil spring, so that the other end of the moving contact piece is not subjected to unexpected elastic deformation and a switch is obtained, which can ensure a predetermined contact pressure and is stable in operating characteristics.

Also, even when the base, the operating lever, etc. involve dispersion in dimensional accuracy and assembly accuracy, the moving contact piece is elastically deformed to absorb an error, so that high part accuracy and assembly accuracy are not needed and manufacture is easy.

Further, since the moving contact piece turns about an end thereof and the other end thereof slides on the inner surface of the base, a twist angle of the whole moving contact piece is smaller than that in the related art. Therefore, since a torsional moment acting on the moving contact piece is small, there is produced an effect that a large operating force is not necessary and a switch is obtained, which is hardly susceptible to fatigue and long in life.

According to the embodiment of the invention, the stationary contact exposed from the inner surface of the base may comprise a normally opened stationary contact, or a normally closed stationary contact, or a normally opened stationary contact and a normally closed stationary contact.

According to the embodiment, there is obtained a switch, for which freedom in selecting a product is increased and which is wide in usage.

A switch according to another invention has a construction comprising a base, a moving contact piece made of a coil spring and having one end thereof, which is supported pivotally on the base, coming into pressure contact with a common stationary contact, an operating lever having one end thereof supported pivotally on the base and having a drive part, which extends from the one end, pushing a coil portion of the moving contact piece, and a cover having a planar shape capable of covering the base and fixed to the base to compress the coil portion, and in which the operating lever pushes the coil portion of the moving contact piece to give thereto a torsional moment whereby the moving contact piece turns about an end thereof, the coil portion of the moving contact piece slides on at least one stationary contact exposed from a bottom surface of the base, and the other end of the moving contact piece slides on an inner surface of the base.

According to the invention, the operating lever pushes the coil portion of the moving contact piece, which is made of a coil spring, whereby the coil portion compressed by the cover comes into pressure contact with the stationary contact to enable ensuring a predetermined contact pressure, so that a switch is obtained, which is stable in operating characteristics.

Also, even when the base, the operating lever, etc. involve dispersion in dimensional accuracy and assembly accuracy, the moving contact piece is elastically deformed to absorb an error, so that high part accuracy and assembly accuracy are not needed and manufacture is easy.

Further, since the moving contact piece turns about an end thereof and the other end thereof slides, a twist angle of the whole moving contact piece is smaller than that in the related art. Therefore, since a torsional moment acting on the moving contact piece is small, a large operating force is not necessary and a switch is obtained, which is hardly susceptible to fatigue and long in life.

According to the embodiment of the invention, the stationary contact exposed from the bottom surface of the base may comprise a normally opened stationary contact and a normally closed stationary contact.

The embodiment produces an effect that there is obtained a switch, for which freedom in selecting a product is increased and which is wide in usage.

DETAILED DESCRIPTION OF THE INVENTION

Figure 1:
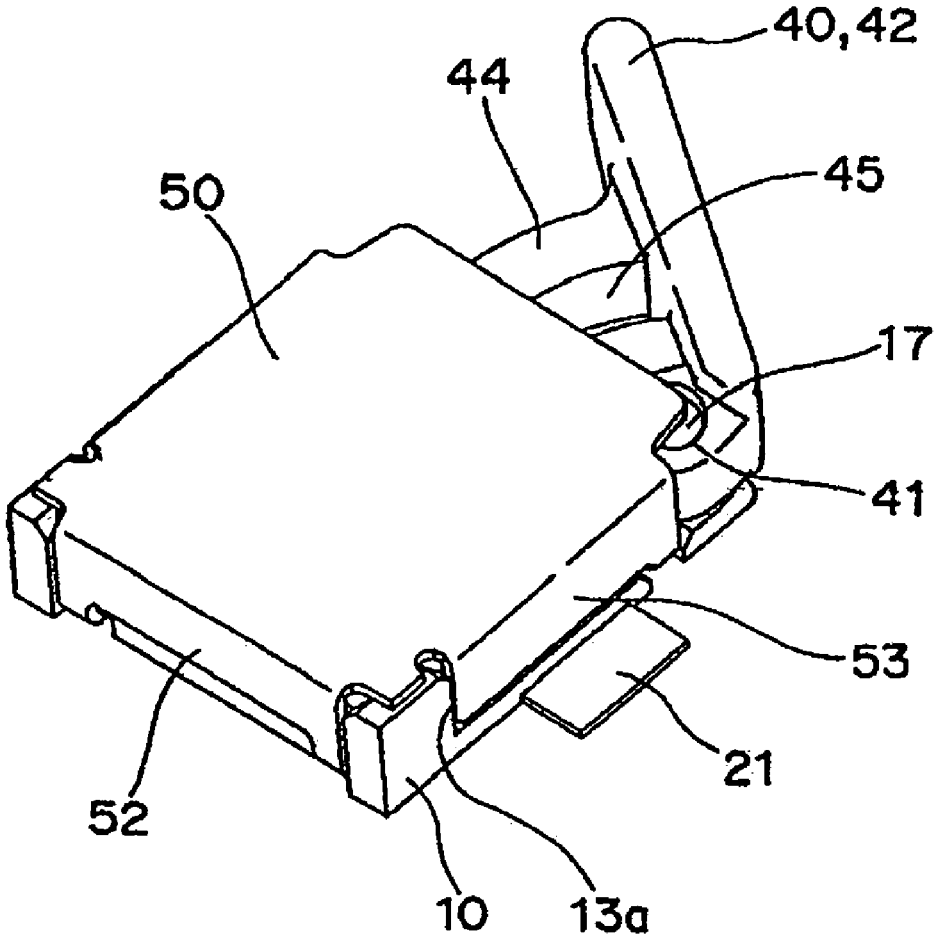
FIG. 1 is a perspective view showing the whole of a first embodiment of a switch according to the invention.
Figure 2:
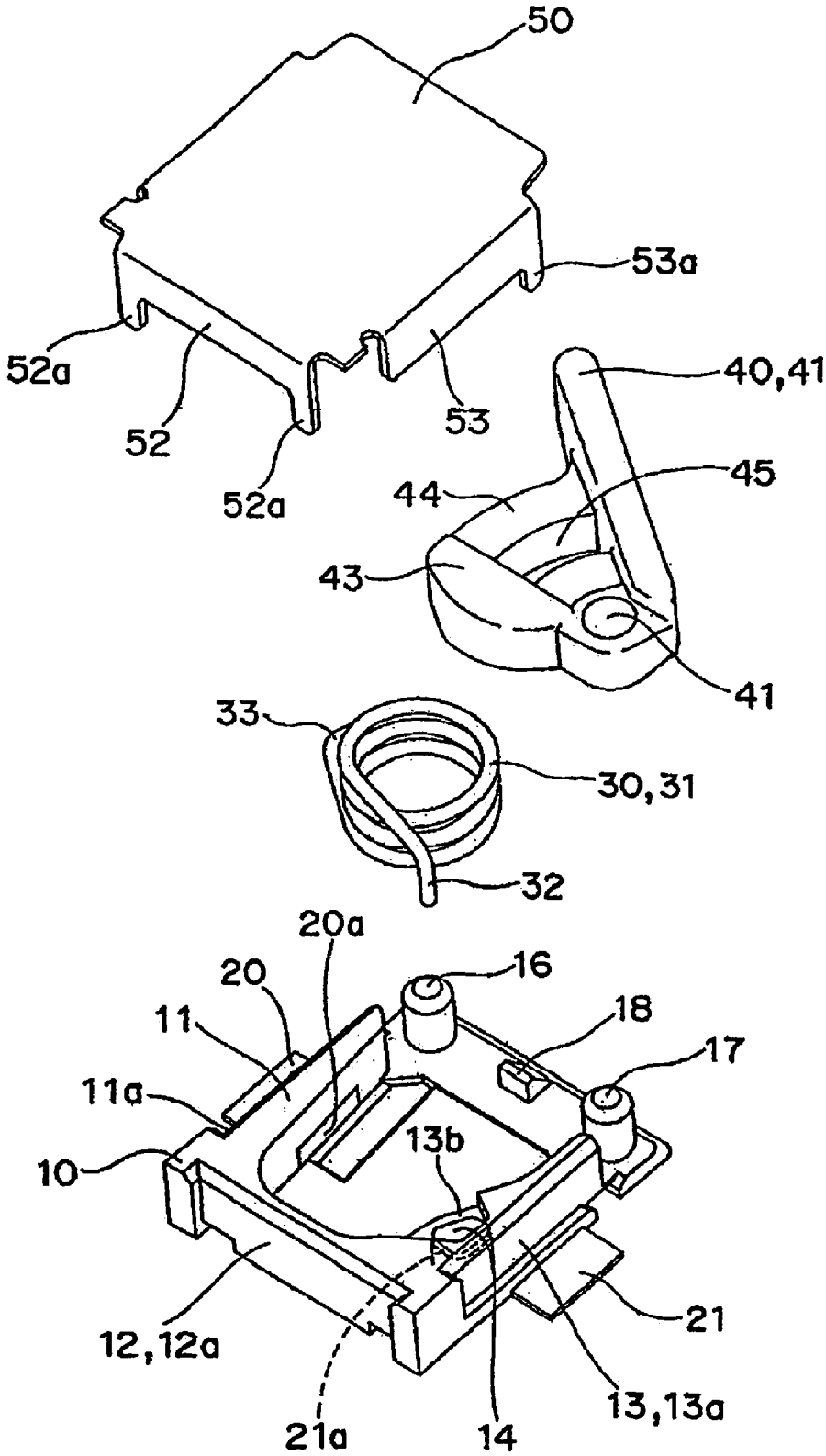
FIG. 2 is an exploded, perspective view showing the switch shown in FIG. 1.
Figure 3:
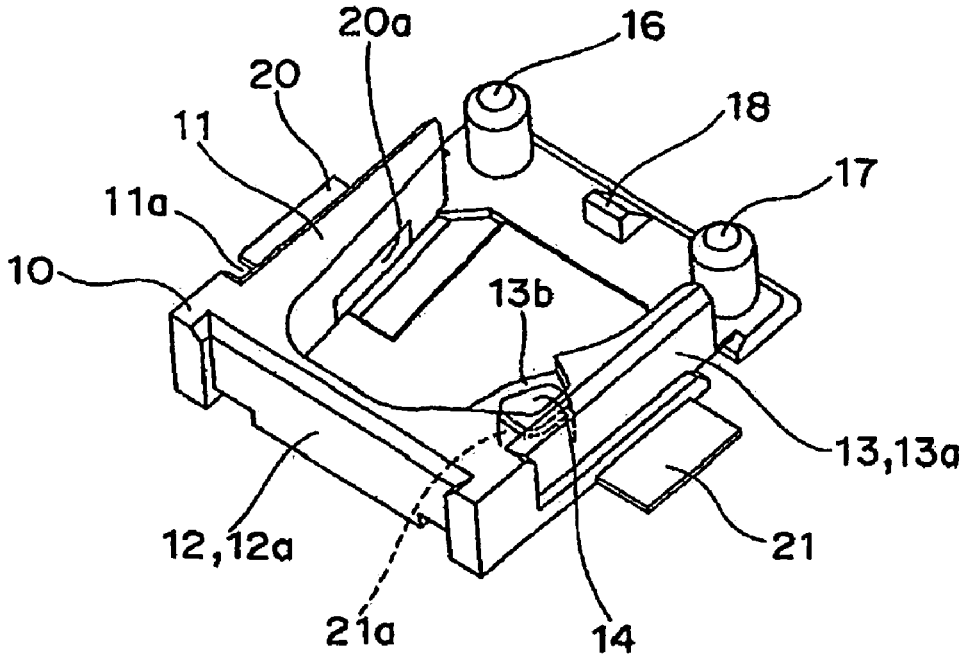
FIG. 3A is a perspective view showing a base of the switch shown in FIG. 2.
FIG. 3B is a perspective view showing contact terminals shown in FIG. 2.
Figure 3:
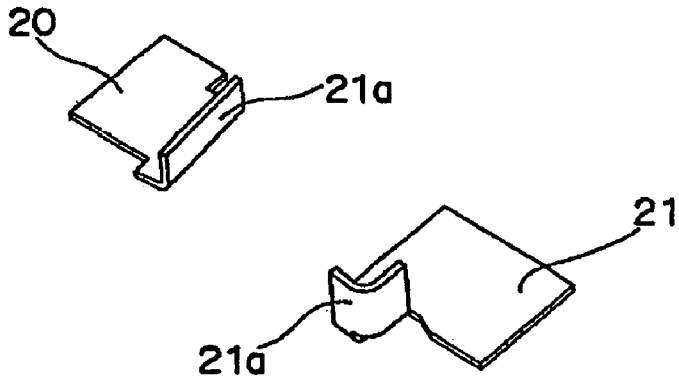

Embodiments of the invention will be described below with reference to the accompanying drawings of FIGS. 1 to 11.

A first embodiment comprises, as shown in FIGS. 1 to 5, a base 10, into which stationary contact terminals 20, 21 are insert-molded, and which is square in plan, a moving contact piece 30 made of a coil spring, an operating lever 40 supported pivotally on the base 10, and a cover 50 that covers the base 10. In addition, an exemplary product as actually assembled has an outside dimension of a total height 0.9 mm, a base width of 3.0 mm, and a length of 3.5 mm.

The base 10 comprises substantially U-shaped side walls 11, 12, 13 provided continuously and protrusively along a peripheral edge of an upper surface thereof, and the stationary contact terminals 20, 21, respectively, are insert-molded on the opposite side walls 11, 13. Positioning steps 11*a*, 13*a*, respectively, are provided on outer side surfaces of the side walls 11, 13, on which the stationary contact terminals 20, 21 are insert-molded, while a positioning recess 12*a* is formed on an outer side surface of the side wall 12 positioned between the side walls 11, 13. Further, a low step 13*b* is formed on an inside edge of the upper surface of the side wall 13, on which the stationary contact terminal 21 is insert-molded, and a latch hole 14 is provided on the step 13*b* to have an end 32 of the moving contact piece 30 latched thereon. A common stationary contact 21*a* is exposed from an inner peripheral surface of the latch hole 14. Also, a normally opened stationary contact 20*a* of the stationary contact terminal 20 is exposed from an inner surface of the side wall 11, on which the stationary contact terminal 20 is insert-molded. Further, the base 10 comprises spindles 16, 17 protrusively provided at adjacent corners on that outer peripheral edge of the upper surface, which is not provided with any side wall, to support an operating lever 40 described later, and a coming-off preventive projection 18 protrusively provided between the spindles 16, 17 to prevent coming-off of the operating lever 40.

An end 32 of the moving contact piece 30 made of a coil spring, which extends from an upper end of a coil portion 31 to be bent, is inserted into the latch hole 14 of the base 10 and pivotally supported and is press-contact with the common stationary contact 21*a*. On the other hand, the other bent end 33 functioning as a moving contact can slide on the inner surface of the side wall 11 of the base 10 and contact with the normally opened stationary contact 20*a*. The moving contact piece 30 is arranged so that the coil portion 31 slides on a bottom surface of the base 10.

The operating lever 40 comprises an axial hole 41 positioned in a central position of a substantially sector shape in plan view and fitted rotatably onto the spindles 16, 17 of the base 10. An operating part 42 and a drive part 43 extend at a predetermined angle about the axial hole 41, and an arcuate groove 45 about the axial hole 41 is formed by connecting the operating part 42 and the drive part 43 to each other by means of a reinforcement rib 44. In addition, the axial hole 41 of the operating lever 40 can be fitted on either of the spindles 16, 17 of the base 10, and the drive part 43 is shaped to be able to appropriately drive the moving contact piece 30 even in the case where the operating lever 40 is supported by either of the spindles 16, 17.

The cover 50 has a planar shape to enable covering the base 10. However, an insulating sheet (not shown) may be stuck integrally to a roof surface of the cover at need. The cover 50 is bent vertically from three adjacent outer peripheral edges to form engagement tongue pieces 51 (not shown), 52, 53, and bendable pawls 51*a* (not shown), 52*a*, 53*a*, respectively, are extended from lower end edges of the tongue pieces 51, 52, 53.

Subsequently, an explanation will be given to a method of assembling the switch according to the embodiment.

First, the end 32 of the moving contact piece 30 is latched and supported pivotally on the latch hole 14 of the base 10, into which stationary contact terminals 20, 21 are insert-molded, to be accommodated on the upper surface of the base 10. Thereby, the end 32 of the moving contact piece 30 is brought into contact with the common stationary contact 21*a* and the other end 33 can contact with the normally opened stationary contact 20*a*, while the coil portion 31 is placed slidably on the upper surface of the ridge 15. The axial hole 41 of the operating lever 40 is fitted on, for example, the spindle 17 of the base 10 to be supported pivotally thereon Then, the cover 50 is put on the base 10 to be pushed thereagainst whereby the tongue pieces 51, 53 and the tongue piece 52, respectively, are engaged by the positioning steps 11*a*, 13*a* and the recess 12*a* to be positioned. Thereby, the coil portion 31 is compressed, so that a lowermost end surface of the coil portion 31 can contact with the bottom surface of the base 10 at a predetermined contact pressure. When the operating lever 40 is pushed inward against the spring force of the moving contact piece 30 in this state, the drive part 43 gets over the coming-off preventive projection 18 and the projection 18 is latched in the arcuate groove 45. Therefore, even when the operating lever 40 is biased outward by the moving contact piece 30, it is prevented from coming off and the end 32 of the moving contact piece 30 is brought into pressure contact with the common stationary contact 21*a* at a predetermined contact pressure. Thereafter, the assembling work is completed by inward by bending the engagement pawls 51*a*, 52*a*, 53*a* of the tongue pieces 51, 52, 53 and fixing the cover 50 to the base 10.

Subsequently, an explanation will be given to a method of operating the switch.

In the case where any operating force is not exerted on the operating lever 40, a spring force generated on the moving contact piece 30 by an action of beforehand loaded torsion causes the end 32 to be brought into pressure contact with the common stationary contact 21*a* and the other end 33 to be brought into pressure contact with the inner surface of the side wall 11 at a predetermined contact pressure.

Figure 4:
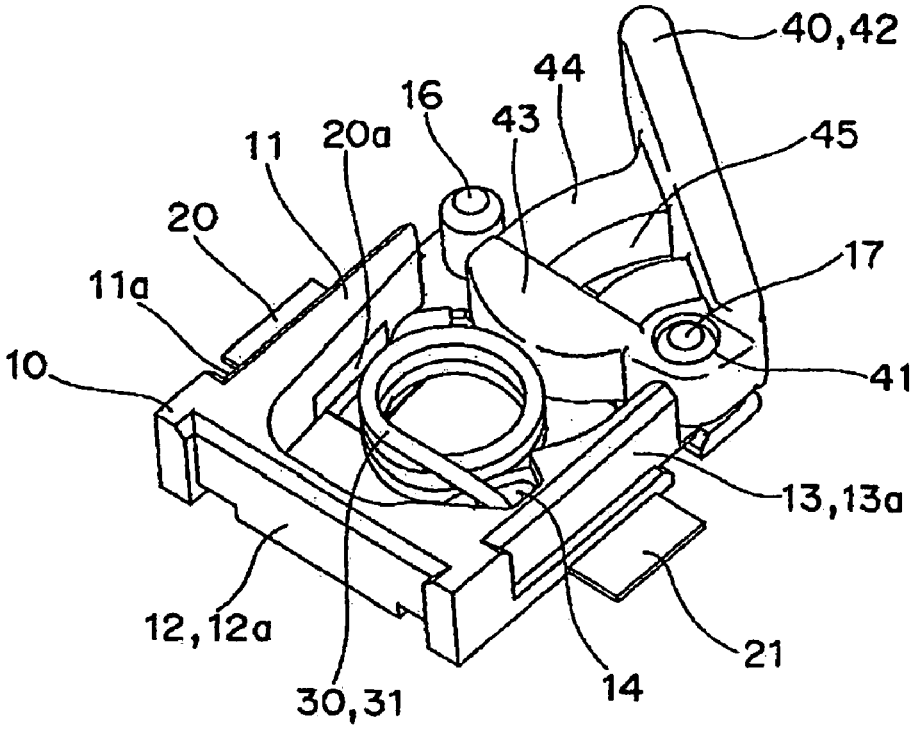
FIGS. 4A and 4B are perspective views showing the switch shown in FIG. 1 before and after operation.
Figure 4:
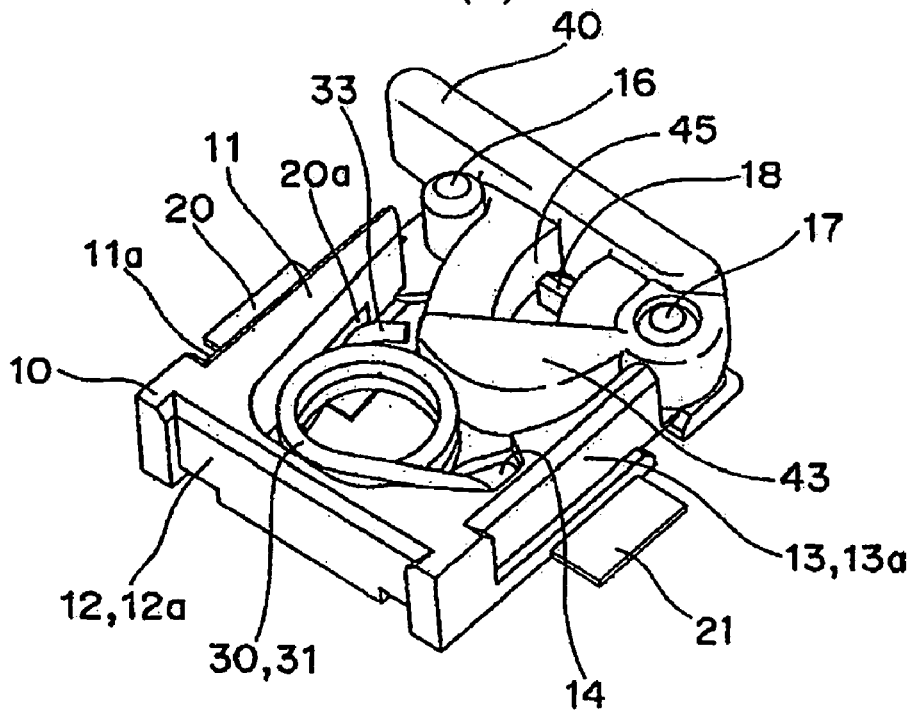
Figure 5:
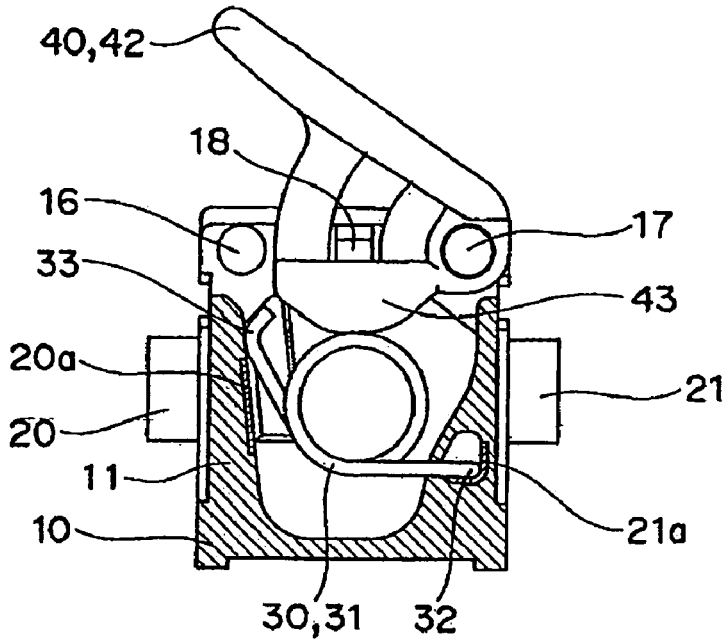
FIGS. 5A, 5B, and 5C are horizontal, cross sectional views showing the switch shown in FIG. 1 before, during, and after operation.
Figure 5:
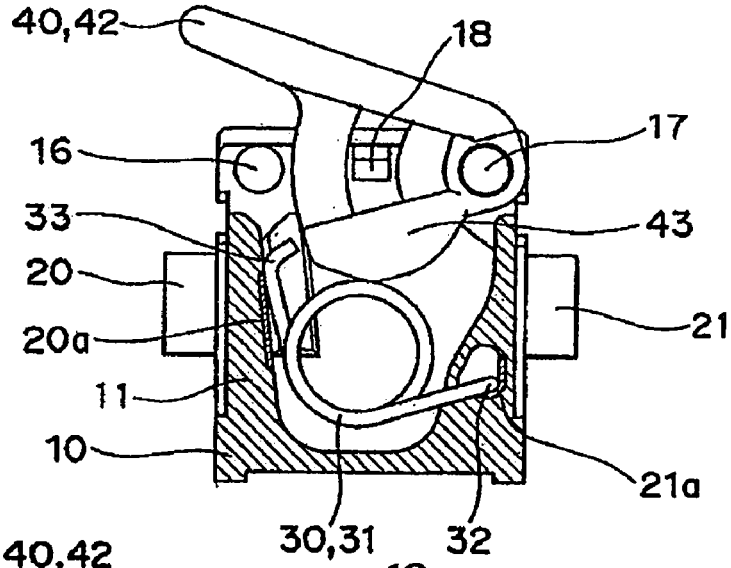
Figure 5:
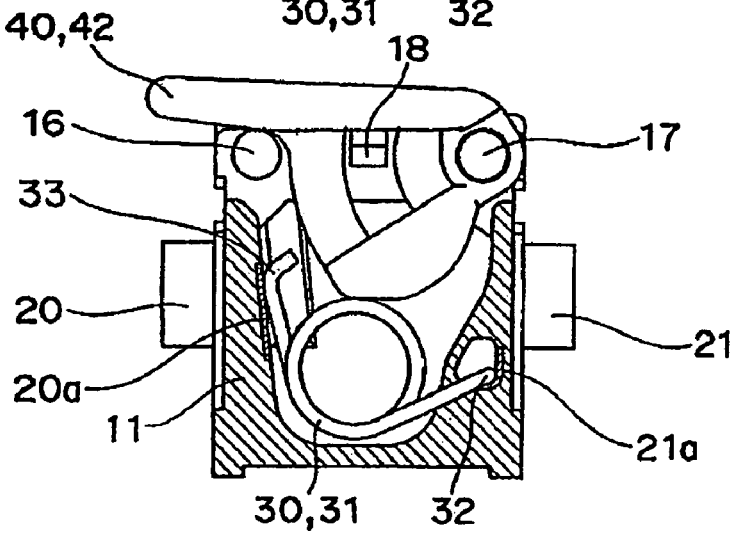

When the operating part 42 of the operating lever 40 is pushed in, the drive part 43 pushes the coil portion 31 as shown in FIGS. 4 and 5. Therefore, a torsional moment acting on the coil portion 31 increases, so that the operating lever 40 turns about the spindle 17 against the spring force of the moving contact piece 30 and the other end 33 slides on the inner surface of the side wall 11 to contact with the normally opened stationary contact 20*a*.

When a load on the operating lever 40 is released, the operating lever 40 is pushed back outward by the spring force of the moving contact piece 30. Therefore, the moving contact piece 30 turns about the end 32 of the moving contact piece 30 in a reverse direction to the direction described above, and the other end 33 thereof slides on the stationary contact 20*a* to effect opening.

According to the embodiment, the moving contact piece 30 turns deforming elastically to open and close the contact whereby a switch is obtained, which does not need as high part accuracy and assembly accuracy as those in the related art, and which is high in productivity and stable in operating characteristics.

In particular, since the other end 33 of the moving contact piece 30 moves sliding on the stationary contact 20*a*, an angle of torsion generated on the moving contact piece 30 is small as compared with the case where the other end does not move. Therefore, an internal stress generated on the moving contact piece 30 is small and fatigue failure is hard to occur.

Further, according to the embodiment, not only an operation in a counterclockwise direction but also an operation in a clockwise direction can be accommodated by fitting the operating lever 40 onto the spindle 16. Therefore, since parts can be used in common, a single metallic mold can serve, thus enabling reduction in production cost. Consequently, according to the embodiment, there is an advantage that a switch capable of accommodating operation in three directions can be manufactured by a single kind of metallic mold.

Figure 6:
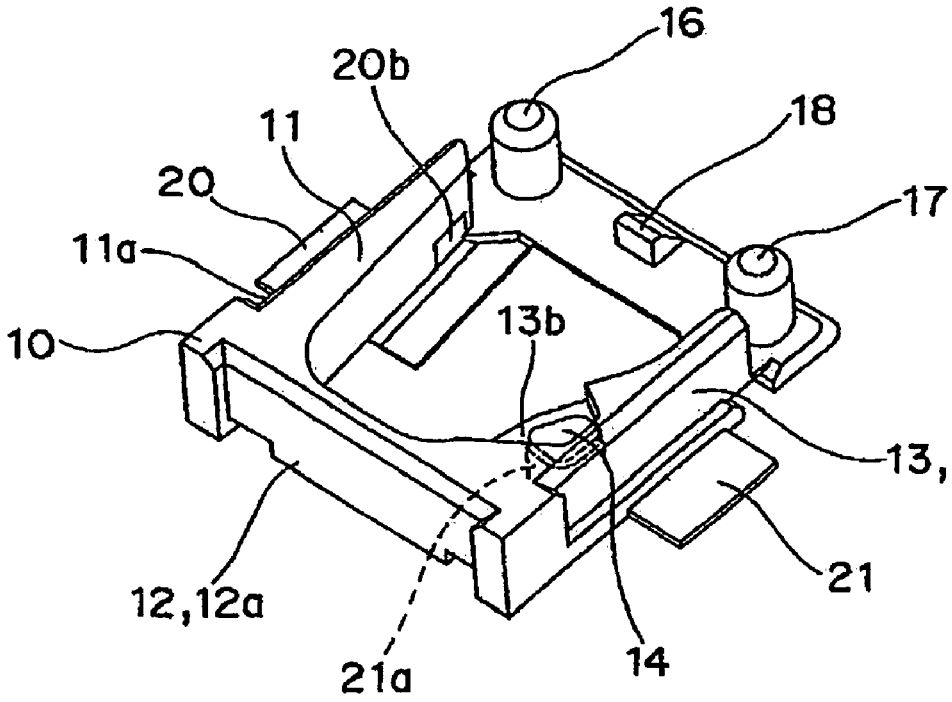
FIGS. 6A and 6B are perspective views showing a base and contact terminals according to a second embodiment of the invention.
Figure 6:
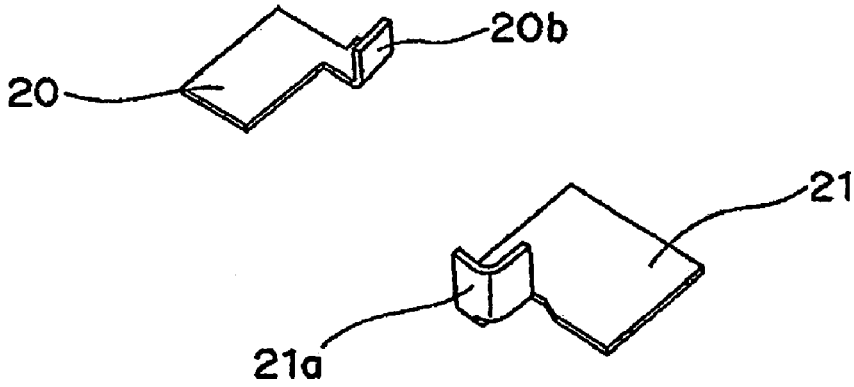
Figure 8:
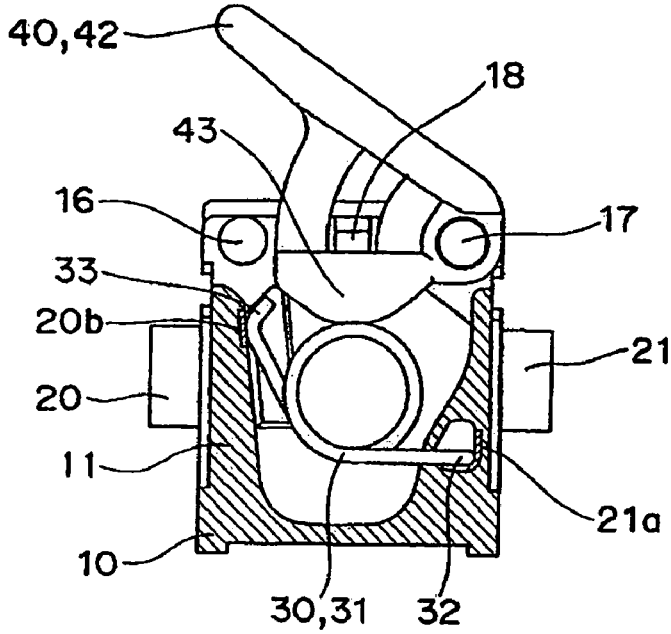
FIGS. 8A, 8B, and 8C are plan views showing the switch shown in FIG. 6 before, during, and after operation.
Figure 8:
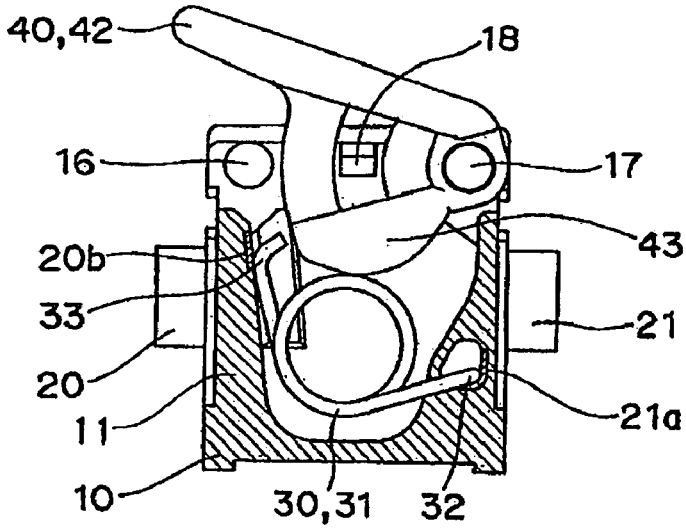
Figure 8:
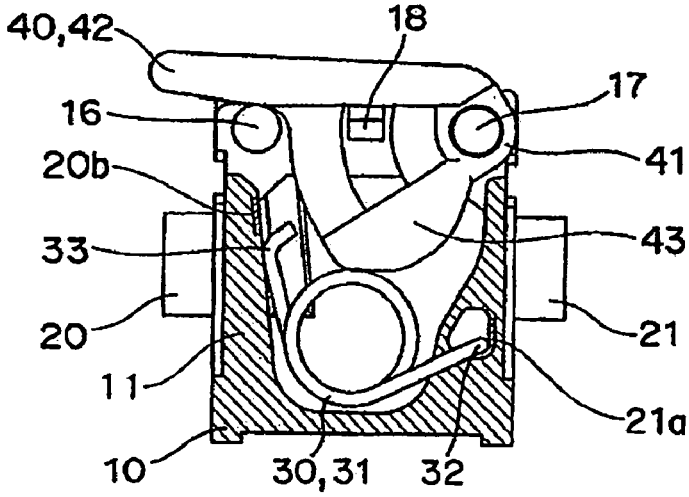
Figure 9:
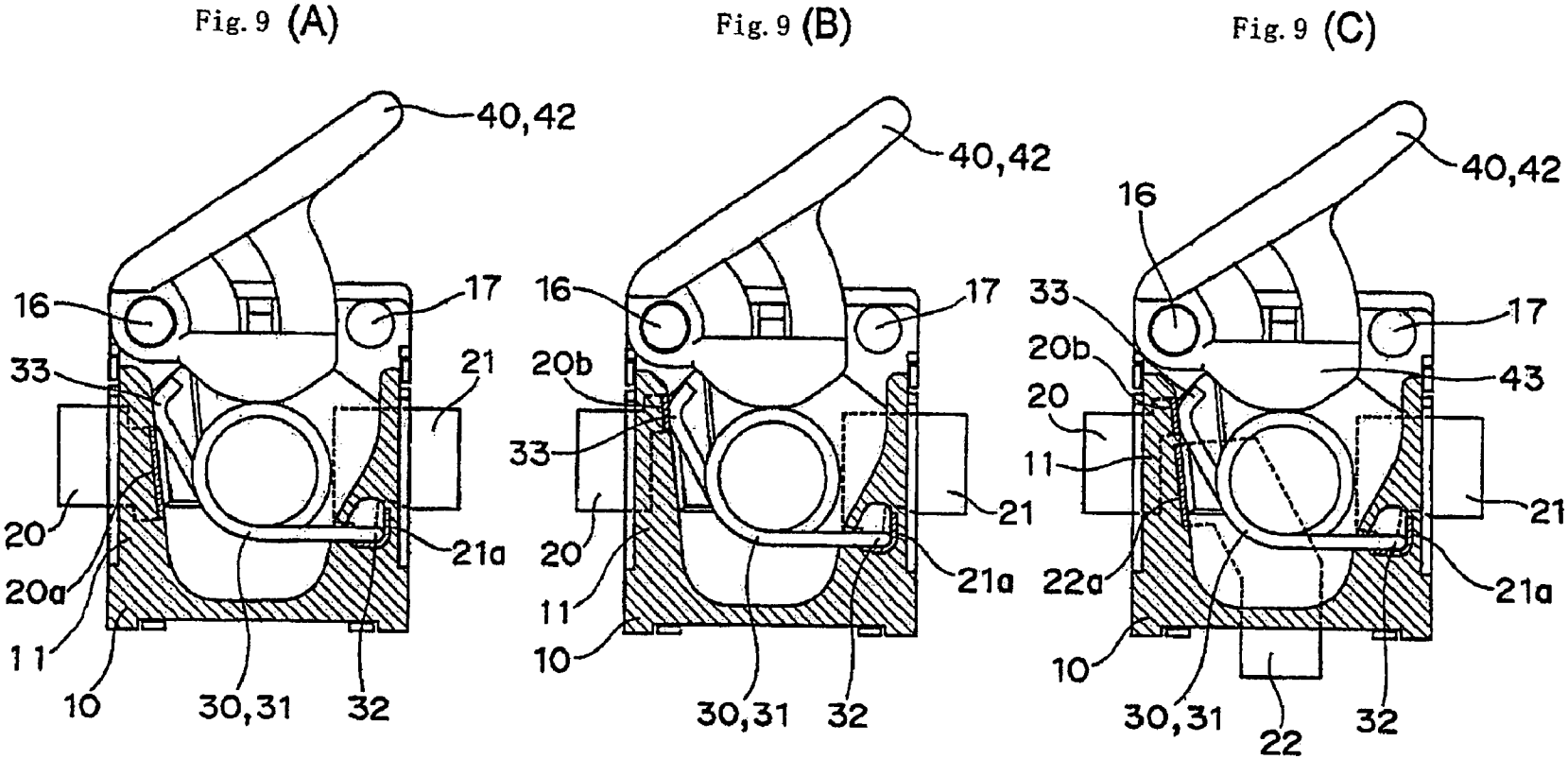
FIGS. 9A, 9B, and 9C are horizontal, cross sectional views illustrating different methods of using the first, second, and third embodiments according to the invention.
Figure 10:
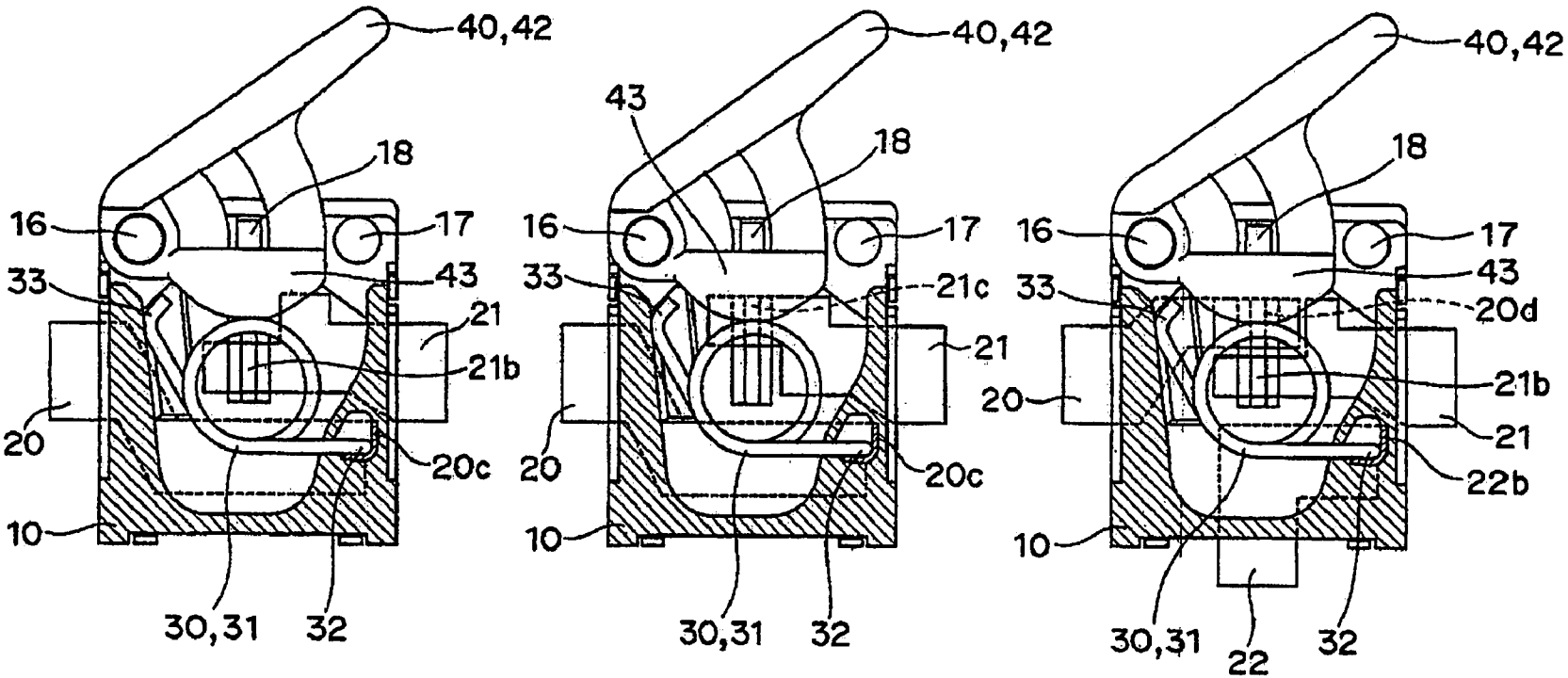
FIGS. 10A, 10B, and 10C are horizontal, cross sectional views showing fourth, fifth, and sixth embodiments according to the invention.

A second embodiment provides a normally closed contact type, in which a normally closed stationary contact 20*b* is arranged on an inner surface 11 of a base 10 as shown in FIGS. 6 and 8.

Figure 7:
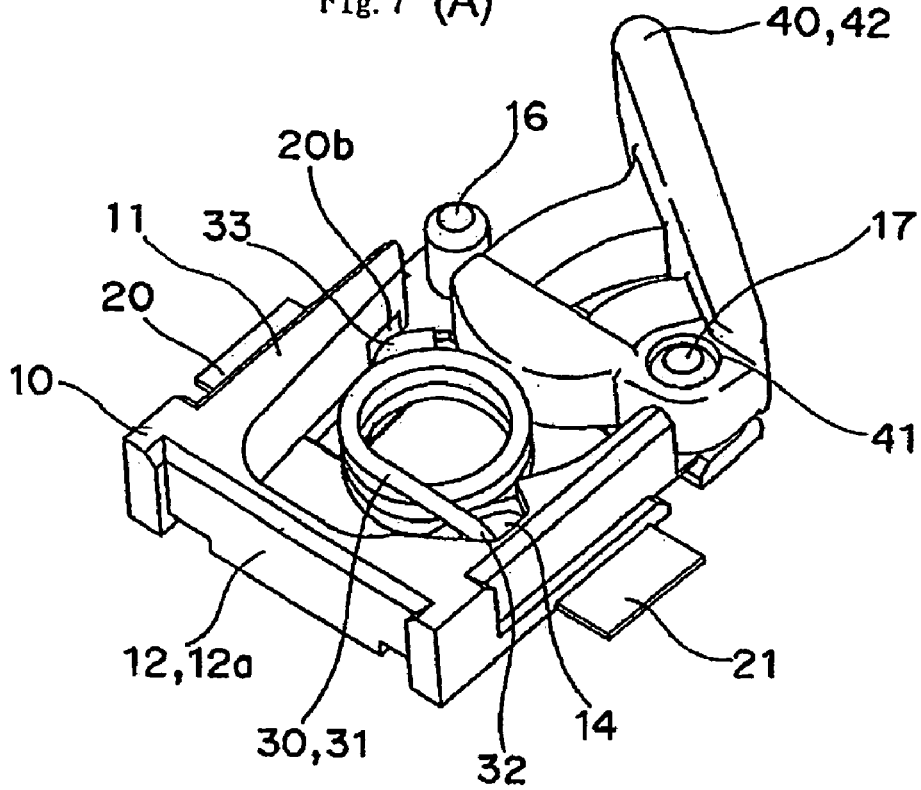
FIGS. 7A and 7B are perspective views showing a switch according to the second embodiment shown in FIG. 6 before and after operation.
Figure 7:
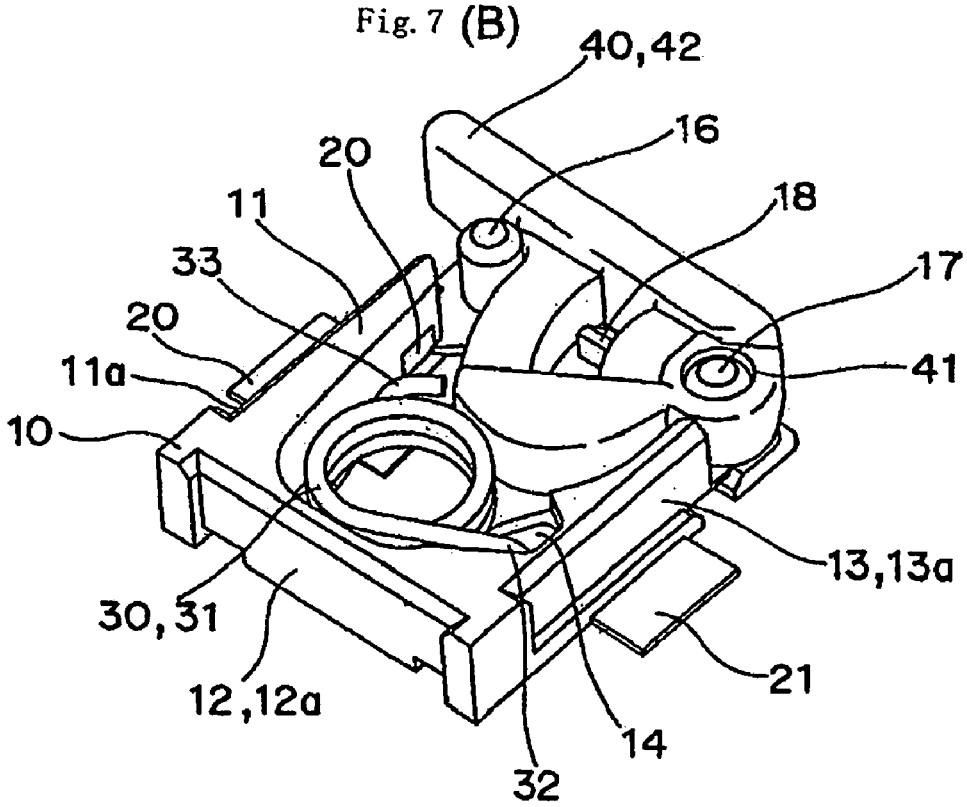

That is, as shown in FIG. 6, a normally closed stationary contact 20*b* is exposed to the inner surface 11 of the base 10. As shown in FIGS. 7 and 8, when an operating lever 40 is pushed in, a torsional moment acting on a coil portion 31 increases, so that the other end 33 slides on the normally closed stationary contact 20*b*. When a load on the operating lever 40 is released, the operating lever 40 is pushed back outward by the spring force of the moving contact piece 30 to return to an original position. Since the rest is the same as that in the embodiment described above, the same parts as those in the latter are denoted by the same reference numerals as those in the latter, and an explanation therefor is omitted.

In addition, as shown in FIGS. 9A and 9B the first embodiment and the second embodiment may be made clockwise by mounting the operating lever 40 on the spindle 16.

According to a third embodiment, a normally closed stationary contact 20*a* and a normally opened stationary contact 22*a* are exposed to an inner surface of a side wall 11.

Accordingly, when an operating lever 40 is pushed in, a torsional moment acting on a coil portion 31 of a moving contact piece 30 increases, so that the moving contact piece 30 turns about an end 32. Therefore, after the other end 33 slides on the normally closed stationary contact 20*a*, it contacts with the normally opened stationary contact 21*b* to switch over the contact. Since the rest is the same as that in the embodiment described above, the same parts as those in the latter are denoted by the same reference numerals as those in the latter, and an explanation therefor is omitted.

According to a fourth embodiment, a normally opened stationary contact 21*b* is arranged on a bottom surface of a base 10 as shown in FIG. 10A.

According to the embodiment, since the normally opened stationary contact 21*b* is arranged on the bottom surface of the base 10, a coil portion 31 of a moving contact piece 30 contacts with the stationary contact 21*b* at a constant contact pressure, so that there is an advantage that dispersion is hard to generate in operating characteristics.

Figure 11:
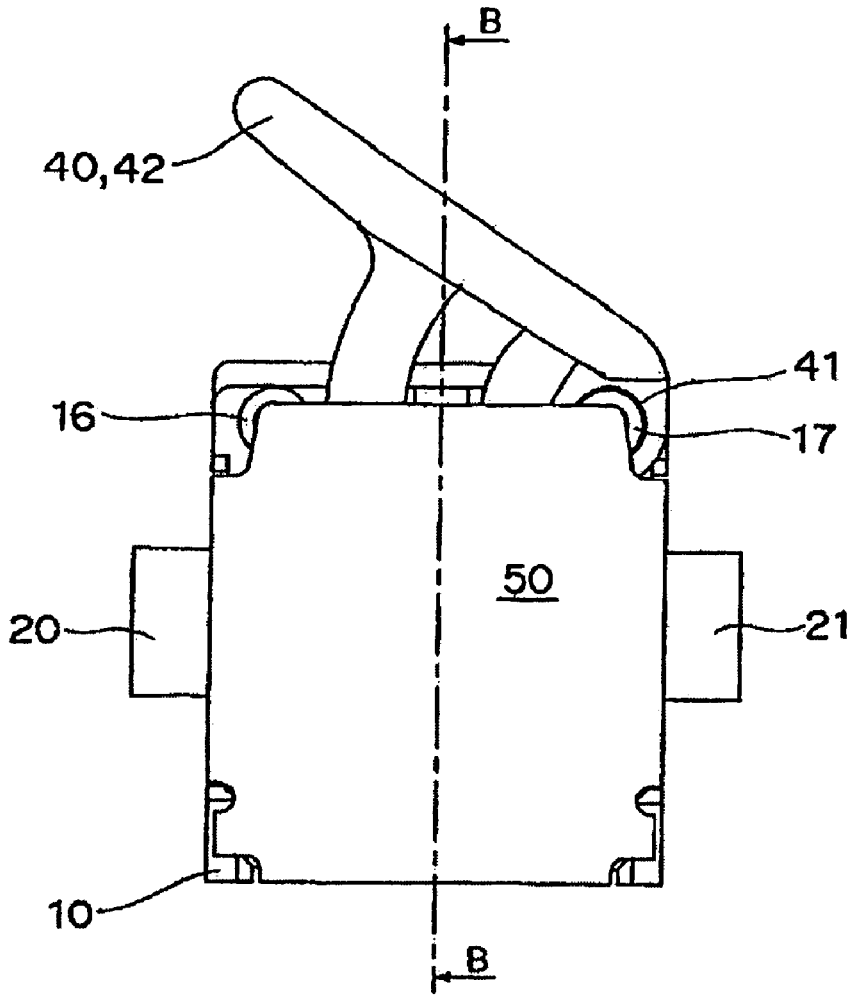
FIGS. 11A and 11B are a plan view and a cross sectional view illustrating different methods of using the fourth embodiment.
Figure 11:
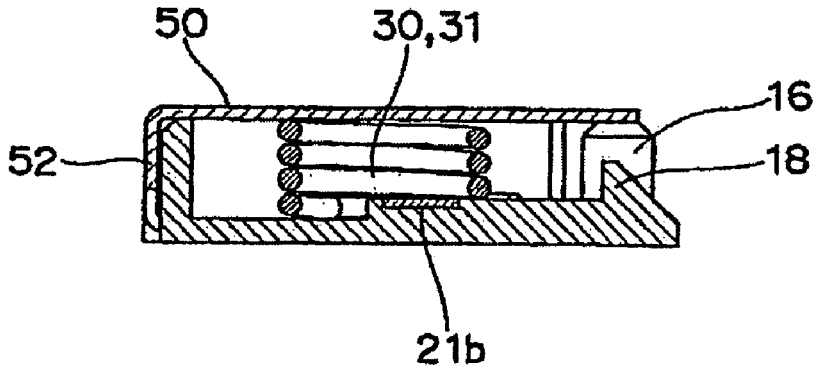

The embodiment may be of course made counterclockwise by mounting the operating lever 40 on the spindle 17 as shown in FIG. 11.

Also, a normally closed stationary contact 21*c* may be arranged on a bottom surface of the base 10 as shown in FIG. 10B (a fifth embodiment). Also, as shown in FIG. 10C, a normally closed stationary contact 20*d* and a normally opened stationary contact 21*b* may be arranged on a bottom surface of the base 10 (a sixth embodiment).

Like the fourth embodiment described above, the fifth and sixth embodiments have an advantage that a switch can be obtained, in which dispersion in contact pressure is hard to generate and which has a stable operating characteristics.

In addition, according to the embodiments, both an operation in a clockwise direction and an operation in a counterclockwise direction can be accommodated by changing a position, in which the operating lever 40 is mounted to the base 10.

Also, while according to the embodiments, an end of the moving contact piece extending from above is supported pivotally on the base, the other end thereof extending from under may be supported pivotally on the base.

The switch according to the invention is of course applicable to a switch other than ones according to the embodiments.

What is claimed is:

1. A switch comprising a base, a moving contact piece made of a coil spring and having one end thereof, which is supported pivotally on the base, coming into pressure contact with a common stationary contact, an operating lever having one end thereof supported pivotally on the base and having a drive part, which extends from the one end, pushing a coil portion of the moving contact piece, and a cover having a planar shape capable of covering the base and fixed to the base to compress the coil portion, and wherein the operating lever pushes the coil portion of the moving contact piece to give thereto a torsional moment whereby the moving contact piece turns about the one end thereof, the coil portion of the moving contact piece slides on a bottom surface of the base, and the other end of the moving contact piece slides on at least one stationary contact exposed from an inner surface of the base.

2. The switch according to claim 1, wherein the at least one stationary contact exposed from the inner surface of the base comprises a normally opened stationary contact.

3. The switch according to claim 1, wherein the at least one stationary contact exposed from the inner surface of the base comprises a normally closed stationary contact.

4. The switch according to claim 1, wherein the at least one stationary contact exposed from the inner surface of the base comprises a normally opened stationary contact and a normally closed stationary contact.

5. A switch comprising a base, a moving contact piece made of a coil spring and having one end thereof, which is supported pivotally on the base, coming into pressure contact with a common stationary contact, an operating lever having one end thereof supported pivotally on the base and having a drive part, which extends from the one end, pushing a coil portion of the moving contact piece, and a cover having a planar shape capable of covering the base and fixed to the base to compress the coil portion, and wherein the operating lever pushes the coil portion of the moving contact piece to give thereto a torsional moment whereby the moving contact piece turns about the one end thereof, the coil portion of the moving contact piece slides on at least one stationary contact exposed from a bottom surface of the base, and the other end of the moving contact piece slides on an inner surface of the base.

6. The switch according to claim 5, wherein the at least one stationary contact exposed from the bottom surface of the base comprises a normally opened stationary contact.

7. The switch according to claim 6, wherein the at least one stationary contact exposed from the bottom surface of the base comprises a normally closed stationary contact.

8. The switch according to claim 5, wherein the at least one stationary contact exposed from the bottom surface of the base comprises a normally opened stationary contact and a normally closed stationary contact.

* * * * *